US005127527A

United States Patent [19]

Graham et al.

[11] Patent Number: 5,127,527

[45] Date of Patent: Jul. 7, 1992

[54] OPENABLE PALLET SLEEVE FOR A PALLET ASSEMBLY

[75] Inventors: Brendon J. Graham; Steven E. Graham, both of Utica, Mich.

[73] Assignee: Graham Creative Packaging Company, Inc., Rochester, Mich.

[21] Appl. No.: 613,997

[22] Filed: Nov. 13, 1990

[51] Int. Cl.[5] ..... B65D 19/38

[52] U.S. Cl. ..... 206/600; 229/239

[58] Field of Search ..... 206/386, 597, 600, 616, 206/617; 229/238, 239

[56] References Cited

U.S. PATENT DOCUMENTS

| | | | |
|---|---|---|---|
| 23,230 | 3/1859 | Colt . | |
| Re. 26,426 | 7/1968 | De Remer et al. | 206/616 X |
| 696,614 | 4/1902 | Wheatley . | |
| 777,771 | 12/1904 | Bettis | 206/617 X |
| 1,515,277 | 11/1924 | Root . | |
| 1,732,282 | 10/1929 | Sage . | |
| 1,901,356 | 3/1933 | Plunkett | 206/617 X |
| 1,906,172 | 4/1933 | Merchant | 206/616 X |
| 2,023,030 | 12/1935 | Plunkett | 206/616 |
| 2,323,335 | 7/1943 | Kaye . | |
| 2,741,420 | 4/1956 | Boderd | 206/616 X |
| 3,237,760 | 3/1966 | De Remer et al. | 206/597 |
| 3,352,480 | 11/1967 | Forman . | |
| 3,372,855 | 3/1968 | Smith | 206/600 X |
| 3,447,733 | 6/1969 | Smith et al. . | |
| 3,451,534 | 6/1969 | De Remer et al. . | |
| 4,399,602 | 8/1983 | Hancock et al. . | |

FOREIGN PATENT DOCUMENTS

| | | | |
|---|---|---|---|
| 547926 | 6/1956 | Belgium | 206/617 |
| 940100 | 2/1956 | Fed. Rep. of Germany | 206/617 |
| 3500427 | 7/1986 | Fed. Rep. of Germany | 206/386 |

*Primary Examiner*—Bryon P. Gehman
*Attorney, Agent, or Firm*—Krass & Young

[57] ABSTRACT

A pallet sleeve 18 for a pallet assembly 10 has a pair of laterally spaced upper slots 36 and a pair of laterally spaced lower slots 34 that are vertically aligned with the upper slots 36. A cord 64 extends through the slots 36 and 34 and has handles 68 and 72 secured to its distal ends 66,70. The sleeve is made from corrugated cardboard with the corrugations running with the vertical slots such that the handles can be pulled to rip the cord 64 through the cardboard from the interior side to the exterior side to remove a panel 44c and create an opening 80 in the side of the pallet sleeve.

15 Claims, 3 Drawing Sheets

OPENABLE PALLET SLEEVE FOR A PALLET ASSEMBLY

TECHNICAL FIELD

This invention relates to packaging and more specifically to a pallet assembly with a removable front panel.

BACKGROUND OF THE INVENTION

Pallets and pallet sleeves have long been a very popular type of storage and shipping container. There are many advantages to pallets and their sleeves. Firstly, the sturdy pallet commonly made from wood is capable of holding heavy weights without breaking down. The pallets keep the contents thereon off the floor which may be wet. Furthermore, the pallets are easily movable with a forklift truck and can be stacked on top of one another when not in use. When in use, it is often desirable to put a protective sleeve made from corrugated cardboard or the like on top of the pallet to protect the contents thereon. The sleeve often has support posts at its four corners for supportive stacking weight on top of the pallet assembly. Furthermore, the large size of the pallet box or sleeve allows one of the side walls to be cut open to form an entry to the interior of the pallet assembly. Opened pallet assemblies can still be stacked and moved about.

One major disadvantage of pallet assemblies is the fact that these pallet sleeves are often opened with a razor or knife. The cutting by the razor or knife from the outside through the cardboard to the inside of the package can often damage the contents in the pallet assembly which can range from automotive seats to pillows.

What is needed is a pallet sleeve which can be opened without the use of a knife or razor and without causing damage to the contents of the pallet assembly.

SUMMARY OF THE INVENTION

According to one aspect of the invention, a pallet assembly includes a pallet with a cap member surrounding the pallet. Vertical supporting posts are laterally positioned within the cap member and spaced therefrom. A pallet sleeve having vertical side walls circumscribe the support posts and each side wall has a lower edge fitting within the cap member between the cap and the posts. One of the side walls has two laterally spaced, vertically extending lower slots extending upward to a position above the cap member. Two laterally spaced, vertically extending upper slots are vertically aligned with the lower slots. It is desirable that the upper slots are aligned vertically over the lower slots to form two sets of vertically aligned pairs of slots.

A pull cord is associated with each pair of slots. Each cord has a pull handle at the exterior of one of the slots. The cord passes through the slot to the interior of the pallet sleeve to the end of the other slot. The other end of the cord has an anchor device such as another pull handle at the exterior side of the other slot such that when one of the pull handles is pulled, the cord rips through the front side panel. The laterally spaced vertical pairs of slots allow for a panel of the side wall to be removed when the cords are pulled through the side walls.

It is desirable that the pairs of slots in the cords are positioned centrally inboard on the one side wall from the posts.

It is preferable that the top edges of each side wall forms a top flange which is folded to a horizontal position. Overlapping sections of flanges are fastened together to add structural strength to the sleeve.

In one embodiment, the cord handles are strips of corrugated cardboard folded about the cord and stapled onto the distal ends of the cord.

It is desirable that the pallet sleeve is made from corrugated cardboard with the corrugations running vertically along with the vertical slots. In one embodiment, the corrugated cardboard is double walled with two varying corrugations or flutes.

In this fashion, the pallet sleeve can be placed within the cap member and can be shipped and moved as desired. When opening is desired, the pull handles are pulled away from the side wall to cause the rip cords to rip through the cardboard of the side wall to remove a substantially sized panel that allows entry into the interior of the pallet assembly. The ripping action of the cord is from the inside toward the outside of the pallet sleeve such that no pointed cutting edge is inserted into the package, thereby eliminating potential for damage of the contents therein.

BRIEF DESCRIPTION OF THE DRAWINGS

Reference now is made to the accompanying drawings in which.

DETAILED DESCRIPTION OF THE PREFERRED EMBODIMENT

Figure 2:
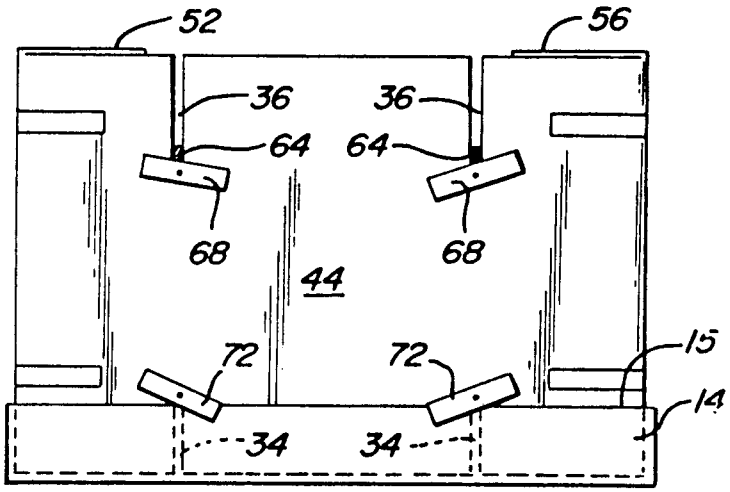
FIG. 2 is a front elevational view of the embodiment shown in FIG. 1.
Figure 3:
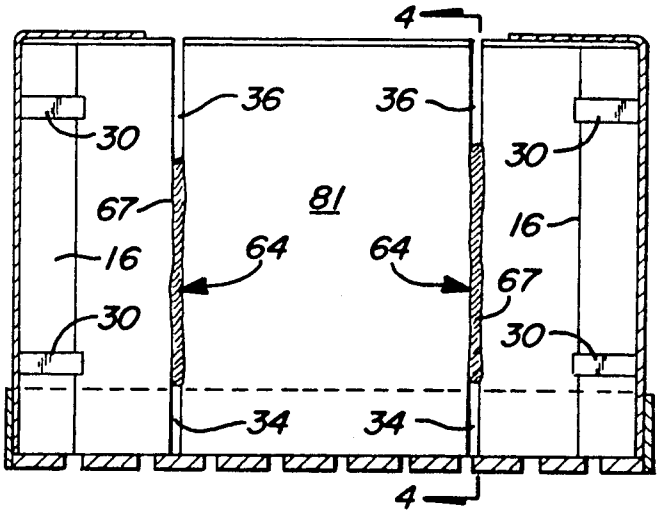
FIG. 3 is a cross-sectional view of the panel assembly taken along the lines 3—3 in FIG. 1.
Figure 1:
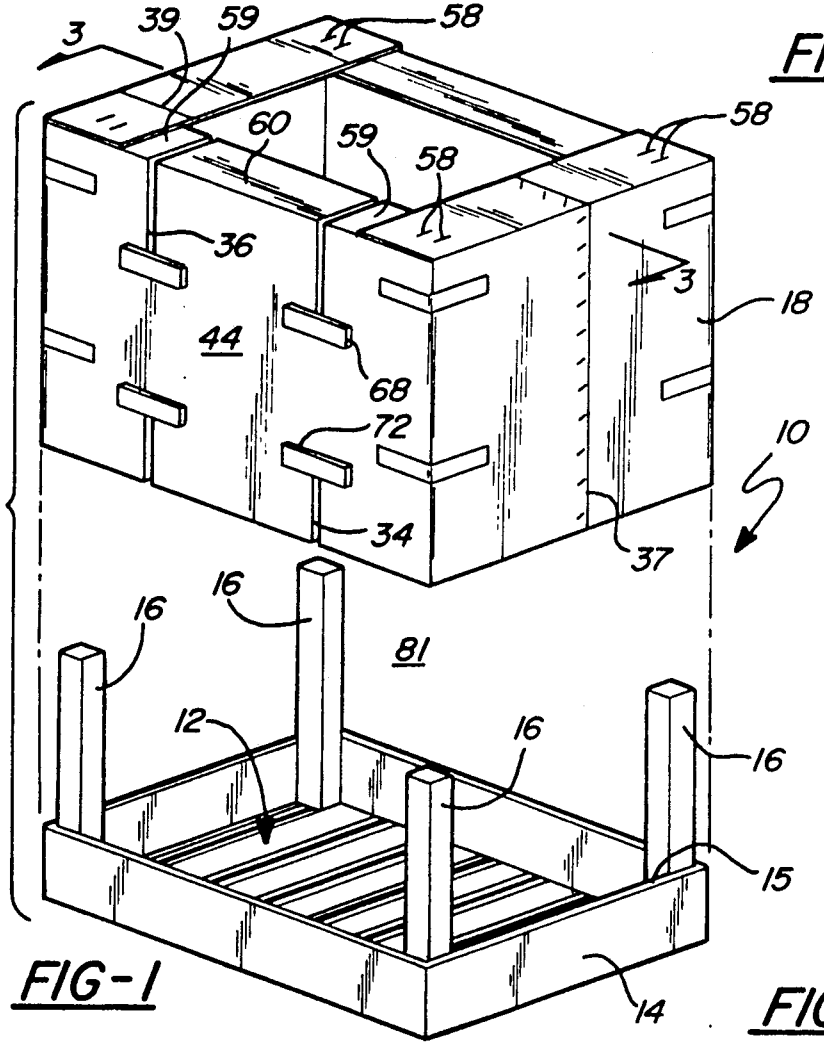
FIG. 1 is a top perspective exploded view of a pallet assembly according to one embodiment of the invention.
Figure 7:
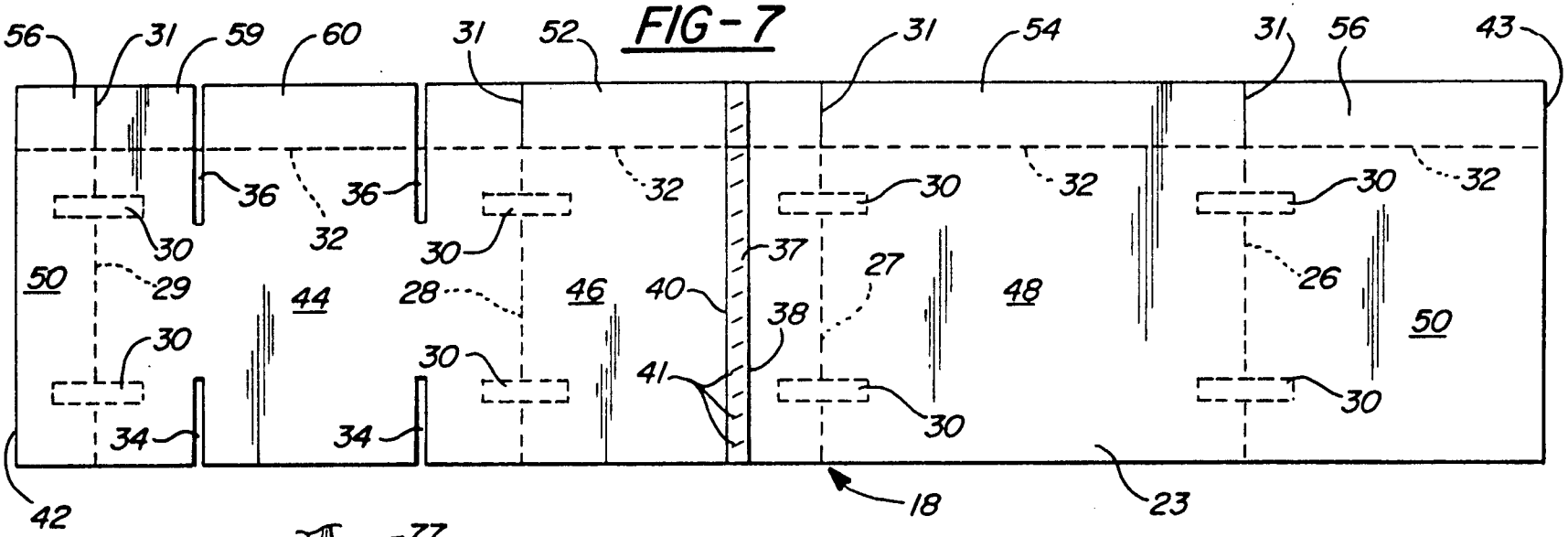
FIG. 7 is a top plan view of corrugated cardboard sheets for forming the pallet sleeve shown in FIG. 1.

Referring now to FIG. 1, a pallet assembly 10 includes a pallet 12, cap 14 and four supporting posts 16. A pallet sleeve 18 slides over the post 16 and within the confines of the cap member 14. Referring to FIG. 1 and FIG. 7, the sleeve is comprised of two blanks 21 and 23 of corrugated cardboard. The corrugated cardboard sheets 21 and 23 are scored and cut to form a plurality of side edges 26, 27, 28 and 29. Strips 30 span over the side edges 26, 27, 28 and 29. Slits 31 are cut into the blanks to score line 32. Also, a pair of lower slots 34 and a pair of upper slots 36 are cut into the blank 21. Blank 21 has its edge 38 overlap edge 40 of blank 23 and the two blanks are stitched together with a plurality of staples 41 to form a seam 37. Similarly, the side edges 26, 27, 28 and 29 are folded such that edge 42 of blank 21 overlaps edge 43 of blank 23 and the two blanks are again similarly stitched together to form seam 39 to form pallet sleeve 18. The seams 38 and 39 are positioned inboard from edges 26, 27, 28 and 29 and strips 30 such that when assembled, the seams 37 and 39 are laterally inboard of posts 16. The score line 32 defines the top edge of side panels 44, 46, 48 and 50 with panels 46, 48 and 50 having flanges 52, 54 and 56 respectively.

Figure 5:
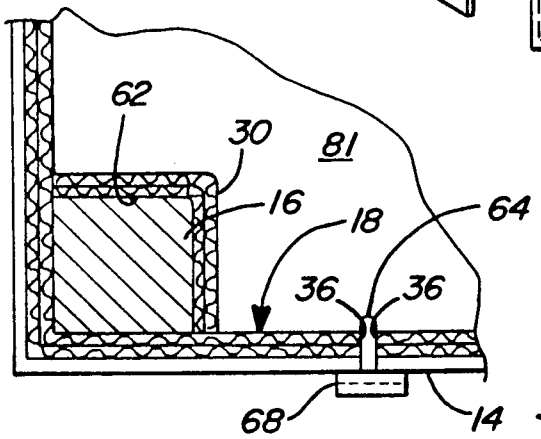
FIG. 5 is an enlarged fragmentary plan and segmented view of one corner of the pallet assembly.

As shown in FIG. 1, these top flanges are folded horizontally and overlap. Where the flanges overlap, they are stitched together by staples 58. In addition, the front side wall 44 has two laterally displaced side flanges and a top central flange 60 partitioned by the upper slots 36. Before the sleeve 18 is placed over the posts 16, the strips 30 are folded inward to form a loop 62 as shown in detail in FIG. 5 to allow the post 16 to pass therebetween and be laterally positioned with respect to the sleeve 18.

The slots 34 and 36 are laterally spaced with respect to each other but are positioned inboard of the posts 16, strips 30, and overlapping flanges 52 and 56 with flanges 59.

Figure 8:
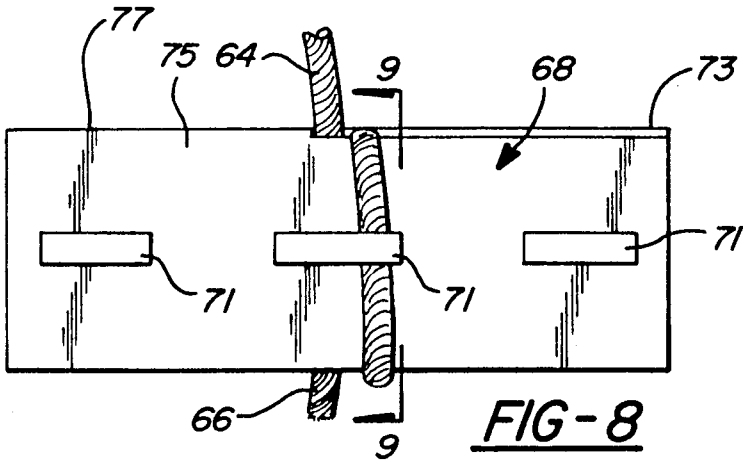
FIG. 8 is an enlarged side elevational view of a handle assembly.
Figure 9:
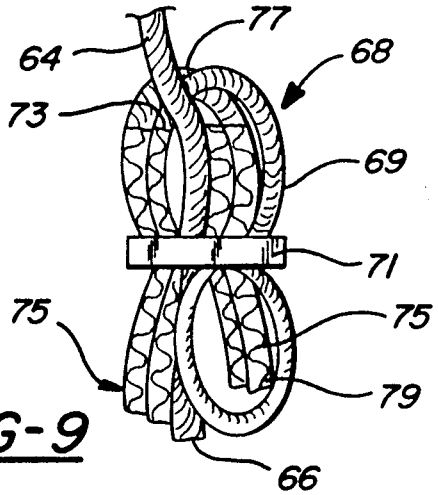
FIG. 9 is a cross-sectional view taken along 9—9 in FIG. 8.

A rip cord 64 is inserted through each upper slot 36 and each lower slot 34. The upper distal end 66 of the cord 64 is attached to a handle 68. The end 66 of cord 64 is secured to the handle 68 as shown in FIGS. 8 and 9. The handle 68 is a piece of folded corrugated cardboard 75 with a slot 73 extending halfway along the top edge 77. The cord 64 passes through slot 73 and is wrapped about one half 79 of the handle and passes a second time through slot 73. A staple 71 secures the two passes inside and one pass outside of cord 64 to the handle 68. Two other staples 71 help keep the cardboard folded shape as shown in FIG. 9. The other end 70 of the cord 64 extends through lower slot 34 and is similarly attached to a handle 72 or other fixed anchoring device. The handles 72 are constructed in the same fashion as handles 68.

Figure 4:
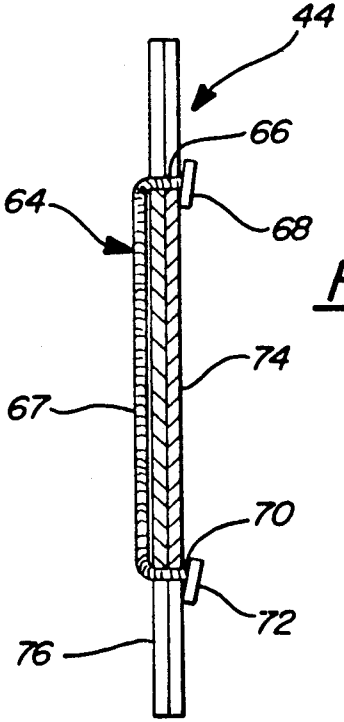
FIG. 4 is a fragmentary cross-sectional view taken along the lines 4—4 shown in FIG. 3.

As shown in FIG. 4, the handles 68 and 72 are on the exterior side 74 of side wall 44 while the middle section 67 of cord 64 is on the interior side 76 of side wall 44. The cap 14 is dimensioned with respect to slots 34 such that when the sleeve is fitted within cap 14, the slot 34 extends above the upper edge 15 of cap 14 such that handles 72 are exposed. The cord 64 is short enough not to allow either handle 68 or 71 to slip to the outer edge of respective slots 36 and 34. In this fashion the pull cord 64 cannot be accidentally disassembled from the sleeve 18 or lost during shipment.

Figure 6:
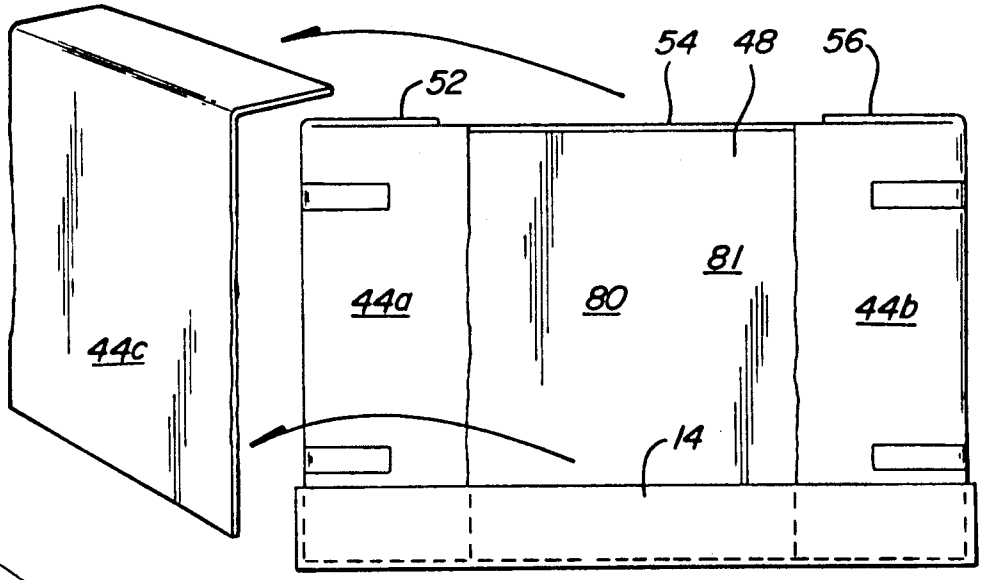
FIG. 6 is a front elevational view similar to FIG. 2 after the pallet assembly has been opened.

The pallet assembly 10 is assembled together as shown in FIG. 1 with the sleeve 18 placed onto posts 16 and in cap 14. Furthermore, the pallet assembly can be shipped, stacked and stored in a conventional manner. When the pallet assembly is desired to be opened, an operator merely grabs one of the handles 68 or 72 or both handles 68 and 72 and pulls on them such that cord 64 rips through the side walls 44. When the cords completely rip through the side wall 44, a large panel section **44*c* is removed and a large opening 80 as shown in FIG. 6 occurs with only peripheral side portions 44*a* and 44*b* of the front side wall 44 still attached. The top peripheral flanges 59 are still attached to flanges 52 and 56 respectively to maintain the support structure of the pallet sleeve 18**.

Furthermore, the action of ripping the side wall 44 is from the interior side 76 outward through the exterior side 74 such that there is no need to insert a knife inwardly and produce a cutting action to the interior of the pallet assembly. As such, potential for damage to the contents is thereby reduced.

The opening 80 allows for easy entry into the interior 81 of the pallet assembly to remove the contents therefrom. Furthermore, the pallet assembly as shown in FIG. 6 can be stacked and stored in a conventional fashion without loss of structural integrity of the pallet assembly.

The materials used to manufacture the pallet sleeve are easily available. The pallet sleeve is made from corrugated cardboard such as 200 pounds or 275 pounds weight. Double wall construction corrugated cardboard is preferred. However, under special circumstances, triple wall construction can be used. The double wall construction as shown in FIG. 4 can have two different flute sizes such as flutes A and C schematically illustrated. The corrugations run vertical in the same direction as the vertical slots 34 and 36 and in the same direction as the cord 64 and the ripping action caused by the cord 64.

The corrugations run parallel to the slots and parallel to the ripping action of the cord through the corrugations to allow a single person of average strength to open the pallet sleeve side wall 44 unassisted. Furthermore, the vertical corrugations provide for stacking strength of the sleeve.

The rip cord 64 can be made from all purpose synthetic No. 1000 Polytwine 10 lb. weight from Winmore. However, it is foreseen that many other kinds of twine or cording can be used. The cord 64 material must be strong enough to rip through the corrugated cardboard side wall 44. If different materials are used for the pallet sleeve 18 and cord 64, a match of material must be made so that the cord 64 does not break upon pulling handles 68 and 72. If desired, the handles 68 and 72 can be taped to the outside of wall 44 during long periods of shipment to help minimize accidental snagging of handles 68 and 71.

Pallet sleeves are predominantly rectangular in cross section. However, other polygonal shapes would work with this invention. Furthermore, the slots 34 and 36 are shown on side wall 44; however, the slots 34 and 36 can also be on side walls 46, 48 or 50 and span either seam 37 or 39 such that the seam 37 or 39 can be part of the removable panel.

Other variations and modifications of the present invention are possible without departing from its spirit and scope as defined by the appended claims.

The embodiments in which an exclusive property or privilege are defined as follows; we claim:

1. A pallet sleeve comprising:

four vertical side walls having a top edge and a bottom edge;

each side wall having a top horizontal flange;

the top flange of each side wall folded horizontally and fastened to overlapping sections of the top flanges of adjacent side walls at corners of the sleeve;

one of said side walls having a pair of upper slots extending through its top flange and a pair of lower slots extending upward from its bottom edge;

a cord extending through each top slot and through each bottom slot and passing through the interior of said pallet sleeve along said one side wall; and each cord having one end attached to a pullable handle and its other end attached to an anchor device such that said handle can be pulled to force said cord to cut through said one side wall to remove a substantially sized panel of said one side wall.

2. A pallet sleeve as defined in claim 1 further characterized by:

said anchor device on said other end of said cord being a pullable handle substantially identical to said pullable handle on said one end.

3. A pallet sleeve as defined in claim 2 wherein said pullable handles comprise folded corrugated cardboard fastened to said cords.

4. A pallet sleeve as defined in claim 1 further characterized by said upper slots extending downward through said one side wall.

5. A pallet sleeve as defined in claim 1 further characterized by:

said four side walls made from corrugated cardboard with the corrugations of the cardboard running vertically along said cords.

6. A pallet sleeve as defined by claim 1 further characterized by:

said slots and cords positioned inboard on said one side wall from the inboard edges of the top horizontal flanges of the side walls adjacent said one side wall.

7. A pallet sleeve as defined in claim 1 wherein the sleeve further includes horizontal strips on the interior of the sleeve spanning each of the corners of the sleeve and foldable inwardly to form loops for support posts to slide in.

8. A pallet sleeve comprising:

vertical side walls having common side edges to form a polygon in cross section;

one of said side walls having a pair of horizontally spaced vertical slots at its upper edge and a pair of horizontally spaced vertical slots at its lower edge with said upper and lower vertical slots vertically aligned to form two pairs of slots;

a cord extending through each pair of slots and extending vertically along the interior side of said side wall; and a first and second pull handle fastened to respective ends of each cord for pulling said cord to rip through said one side wall from said interior side outward for removing a panel section positioned between said two pairs of slots.

9. A pallet sleeve as defined in claim 8 further characterized by:

said side walls having top flanges folded horizontally transverse to said side walls and fastened together at overlapping corners for structurally supporting said pallet sleeve.

10. A pallet sleeve as defined in claim 9 further characterized by:

said slots being spaced inboard from said side edges of said one side wall; and the top flange of said one side wall being divided by the vertical slots in the upper edge of said one side wall into a central flange portion and side flange portions flanking said central flange portion, the side flange portions being folded and fastened to the top flanges of adjacent side walls.

11. A pallet sleeve as defined in claim 10 further characterized by:

said vertical side walls made from corrugated cardboard with corrugations within said cardboard running vertical in the same direction as said slots.

12. A pallet assembly comprising:

a pallet member;

a cap member surrounding said pallet member;

vertical supporting posts positioned within said cap member and spaced therefrom;

a pallet sleeve having vertical side walls circumscribing said supporting posts and each side wall having a lower edge fitting between said posts and said cap member;

one of said side walls having two horizontally spaced vertically extending lower slots extending upward to a position above said cap member;

said one side wall having two horizontally spaced vertically extending upper slots vertically aligned with said lower slots;

a pair of cords, each cord extending through a respective one of said upper slots and a respective one of said lower slots aligned with said one of said upper slots, said cords having distal ends positioned on an exterior portion of said sleeve and a mid portion positioned on an interior portion of said sleeve between said respective upper slot and said respective lower slot;

a pull handle attached to each distal end of said cords;

said sleeve member having a top flange extending from each of said side walls with the top flange of each side wall folded down horizontally and fastened to the top flange of adjacent side walls above said posts;

said pairs of slots and cords positioned inboard on said one side wall from said posts.

13. A pallet assembly as defined in claim 12 further characterized by:

said sleeve having foldable strips that fold inward from said side walls to form loops that can retain said posts.

14. A pallet assembly as defined in claim 12 further characterized by:

said pallet sleeve made from at least one sheet of cardboard folded to form said sleeve with a connecting seam at the two ends of said at least one sheet positioned between adjacent posts and on a side wall other than said one side wall.

15. A pallet sleeve comprising:

vertical side walls having common side edges to form a polygon in cross section;

one of said side walls having a pair of horizontally spaced openings in an upper region of said side wall and a pair of horizontally spaced openings in a lower region of said side wall with said upper and lower openings vertically aligned to form two pairs of openings;

a cord extending through each pair of openings and extending vertically along the interior side of said side wall; and a first and second pull handle fastened to respective ends of each cord for pulling said cord to rip through said one side wall from said interior side outward for removing a panel section positioned between said two pairs of openings.

* * * * *

UNITED STATES PATENT AND TRADEMARK OFFICE

CERTIFICATE OF CORRECTION

PATENT NO. : 5,127,527

DATED : July 7, 1992

INVENTOR(S) : Brendon John Graham et al

It is certified that error appears in the above-identified patent and that said Letters Patent is hereby corrected as shown below:

Column 5, Line 4, Delete "claim 2" Insert --claim 1--

Signed and Sealed this

Twelfth Day of October, 1993

*Attest:*

Bruce Lehman

BRUCE LEHMAN

*Attesting Officer*

*Commissioner of Patents and Trademarks*